US008483582B2

(12) United States Patent
Matsuda

(10) Patent No.: US 8,483,582 B2
(45) Date of Patent: Jul. 9, 2013

(54) IMAGE FORMING APPARATUS

(75) Inventor: Masatomo Matsuda, Osaka (JP)

(73) Assignee: Kyocera Mita Corporation (JP)

( * ) Notice: Subject to any disclaimer, the term of this patent is extended or adjusted under 35 U.S.C. 154(b) by 295 days.

(21) Appl. No.: 12/904,518

(22) Filed: Oct. 14, 2010

(65) Prior Publication Data

US 2011/0085806 A1 Apr. 14, 2011

(30) Foreign Application Priority Data

Oct. 14, 2009 (JP) ..... 2009-237579

(51) Int. Cl.
*G03G 15/00* (2006.01)
*G03G 15/08* (2006.01)

(52) U.S. Cl.
CPC .... *G03G 15/0832* (2013.01); *G03G 2221/1823* (2013.01)
USPC ..... 399/12; 399/13; 399/25; 399/53

(58) Field of Classification Search
USPC ..... 399/12, 13, 24, 25, 53
See application file for complete search history.

(56) References Cited

U.S. PATENT DOCUMENTS 7,212,750 B2 * 5/2007 Kawai ..... 399/12
2009/0162078 A1 * 6/2009 Kojo ..... 399/13

FOREIGN PATENT DOCUMENTS

JP 2007-52275 3/2007

* cited by examiner

*Primary Examiner* — Walter L Lindsay, Jr.
*Assistant Examiner* — Jessica L Eley
(74) *Attorney, Agent, or Firm* — Gerald E. Hespos; Michael J. Porco; Matthew T. Hespos

(57) ABSTRACT

An image forming apparatus includes a controller on the apparatus body to control supply of developers from developer containers to the development devices. The controller includes a storage that reads and stores identification information pieces of all the development devices attached to the apparatus body. When any of the development devices is removed from the apparatus body, and thereafter attached at a position where the removal took place, the controller reads an identification information piece of the development device attached at the position, and when the read identification information piece disagrees with an identification information piece of the development device at the position stored, and agrees with an identification information piece of another one of the development devices at another position, the controller determines that the development device is mistakenly attached and prohibits the supply of the corresponding developers.

10 Claims, 9 Drawing Sheets

IMAGE FORMING APPARATUS

BACKGROUND OF THE INVENTION

1. Field of the Invention

The present invention relates to an image forming apparatus capable of forming a multicolor image using developers of a plurality of colors.

2. Description of the Related Art

In a multicolor image forming apparatus that carries out multicolor printing using multicolor toners, for example, as shown in FIGS. 6 to 8, a yellow toner use container 900Y supplies toner of its color to a development device 10Y; a magenta toner use container 900M supplies toner of its color to a development device 10M; a cyan toner use container 900C supplies toner of its color to a development device 10C; and a black toner use container 900K supplies toner of its color to a development device 10K. Then, the toner supplied to each of the development devices 10Y, 10M, 10C, and 10K is supplied to an image forming portion. The multicolor image forming apparatus is configured to obtain a multicolor image by superimposing toner images of respective colors.

The development devices (development devices 100, 200, 300, and 400 in FIGS. 6 to 8) used as these development devices 10Y, 10M, 10C, and 10K are removably attached to the apparatus body, so as to be removed from and attached to the apparatus body when they reach their end of life and to be replaced by new development devices, or for the purpose of maintenance check, cleaning and the like of the apparatus.

Accordingly, in order to allow the apparatus body to recognize any development device being attached or removed, the development devices 100, 200, 300, and 400 have generally installed therein EEPROMs (Electrically Erasable Programmable Read Only Memories) 100*a*, 200*a*, 300*a*, and 400*a* for storing a variety of information (T/C (toner/carrier) data, counter information and the like). Then, data reading/writing or the like is carried out between the EEPROMs 100*a*, 200*a*, 300*a*, and 400*a* and a CPU 210 on the apparatus body side, through a serial bus such as an $I^2C$ bus, such that the attached development device can be recognized on the apparatus body side.

Here, in the following, a description will be given of the processing carried out by a controller 170 when the development device is attached to the apparatus body in the conventional structure described above, with reference to flowcharts of FIGS. 7, 8, and 9.

When the development device 200 is taken out from a port with a communication address 2 of the apparatus body, and a development device 500 is attached to the port with the identical communication address 2, the CPU 210 reads and checks the serial number (the number specific to each development device, such as a manufacturer's serial number) of the attached development device 500 from the EEPROM 500*a* (S11). In the case shown in FIG. 7, the serial number of the development device 500 attached to the port with the communication address 2 is "500". Then, it is determined whether or not the "serial No. 500" of the communication address 2 agrees with the serial number corresponding to the communication address 2, which is previously stored in an EEPROM 220 on the body side (S12). In the case shown in FIG. 7, the serial number corresponding to the communication address 2 previously stored in the EEPROM 220 is the "serial No. 200" of the development device 200 which is just removed and, therefore, it disagrees with the "serial No. 500" of the attached development device (NO in S12). In this case, the CPU 210 recognizes that a new development device 500 is attached as the development device 10C, and the development device 500 is supplied with the cyan toner from the cyan toner use container 900C (S13).

Next, the following discusses a case where a plurality of development devices are removed from the apparatus body for the purpose of maintenance or the like, and thereafter reattached to the apparatus body, and on the assumption that, for example as shown in FIG. 8, they are each mistakenly attached to the port with other communication address being different from the port with the original communication address. In FIG. 8, for example, though the development device 300 should have been reattached to the port with the communication address 3, the development device 300 is mistakenly reattached to the port with the communication address 2. In this case, the serial number of the development device attached to the port with the communication address 2 is "300". While this serial No. 300 is stored in a storage area corresponding to the communication address 3 of the EEPROM 220 on the body side, the serial number stored in a storage area corresponding to the communication address 2 is "200", which disagrees with the "serial No. 300" of the attached development device 300 (NO in S12).

Accordingly, there is the following disadvantage: despite the fact that the development device 300 just attached is the one having been in use as the development device 10M that supplies the magenta purpose toner to the image forming portion of the apparatus body, and merely temporarily been taken outside the apparatus for the purpose of maintenance or the like, it is mistakenly recognized that the development device 300 is attached as a new cyan toner use development device 10C. In this case, the cyan toner supplied from the cyan toner use container 900C is blended with the magenta purpose toner in the development device 300.

Meanwhile, there is a known technique that can prevent a printing operation from being executed while developers of different colors are blended with each other. This technique is configured such that, at the time point where the development device is attached to the apparatus body, the user operates an operational portion arranged on the apparatus body side to enter an input, to thereby confirm or update the toner replacement history, the type of the replaced developer, the life information of the development device and the like, which are stored in the EEPROM of the development device. However, in this case, every time the development device is attached to the apparatus body, the user must update the information required for making a determination as to whether or not any mistaken attachment takes place, and store the updated information in the EEPROM of the development device. Thus, it is disadvantageous in that it requires troublesome operation and processing. Further, the conventional structure described above is configured to report to the user after the fact of mistaken supply of the developer of a different color to the development device, and it is not configured to prevent such mistaken supply of the developer.

SUMMARY OF THE INVENTION

An object of the present invention is to provide an image forming apparatus that is capable of preventing a developer of wrong color from being supplied because of mistaken attachment of any development device, with a simple structure.

In order to achieve the object stated above, an image forming apparatus according to one aspect of the present invention is an image forming apparatus capable of forming a multicolor image using developers of a plurality of colors, including: a plurality of developer containers respectively storing the developers of the plurality of colors; a plurality of development devices provided attachably and removably to an apparatus body, so as to respectively supply the apparatus body with the developers of the plurality of colors respectively supplied from the plurality of developer containers; and a controller provided on a side of the apparatus body, so as to control supply of the developers from the developer containers to the development devices, characterized in that the development devices respectively include first storage portions that are communicably connected to the controller and that have respectively stored therein identification information pieces each uniquely identifying corresponding one of the development devices, the controller includes a second storage portion that reads and stores the identification information pieces of all the development devices attached to the apparatus body, and when any of the development devices is removed from the apparatus body, and thereafter any of the development devices is attached at a position where the removal took place, the controller reads an identification information piece of the development device attached at the position, and when the read identification information piece disagrees with an identification information piece of the development device at the position stored in the second storage portion and agrees with an identification information piece of another one of the development devices at another position, the controller determines that the development device is mistakenly attached and prohibits the supply of corresponding one of the developers.

The present invention can implement an image forming apparatus that is capable of preventing a developer of wrong color from being supplied because of mistaken attachment of any development device, with a simple structure.

DETAILED DESCRIPTION OF THE PREFERRED EMBODIMENTS

In the following, a description will be given of an image forming apparatus according to one embodiment of the present invention with reference to the drawings. It is to be noted that, in the following embodiment, while the description will be given taking up a multicolor printer as an image forming apparatus according to the present invention, the present invention is not limited thereto, and it may be a copying machine, or a multifunction peripheral that possesses a plurality of functions to serve as a copier, a scanner, a facsimile, a printer and the like.

Figure 1:
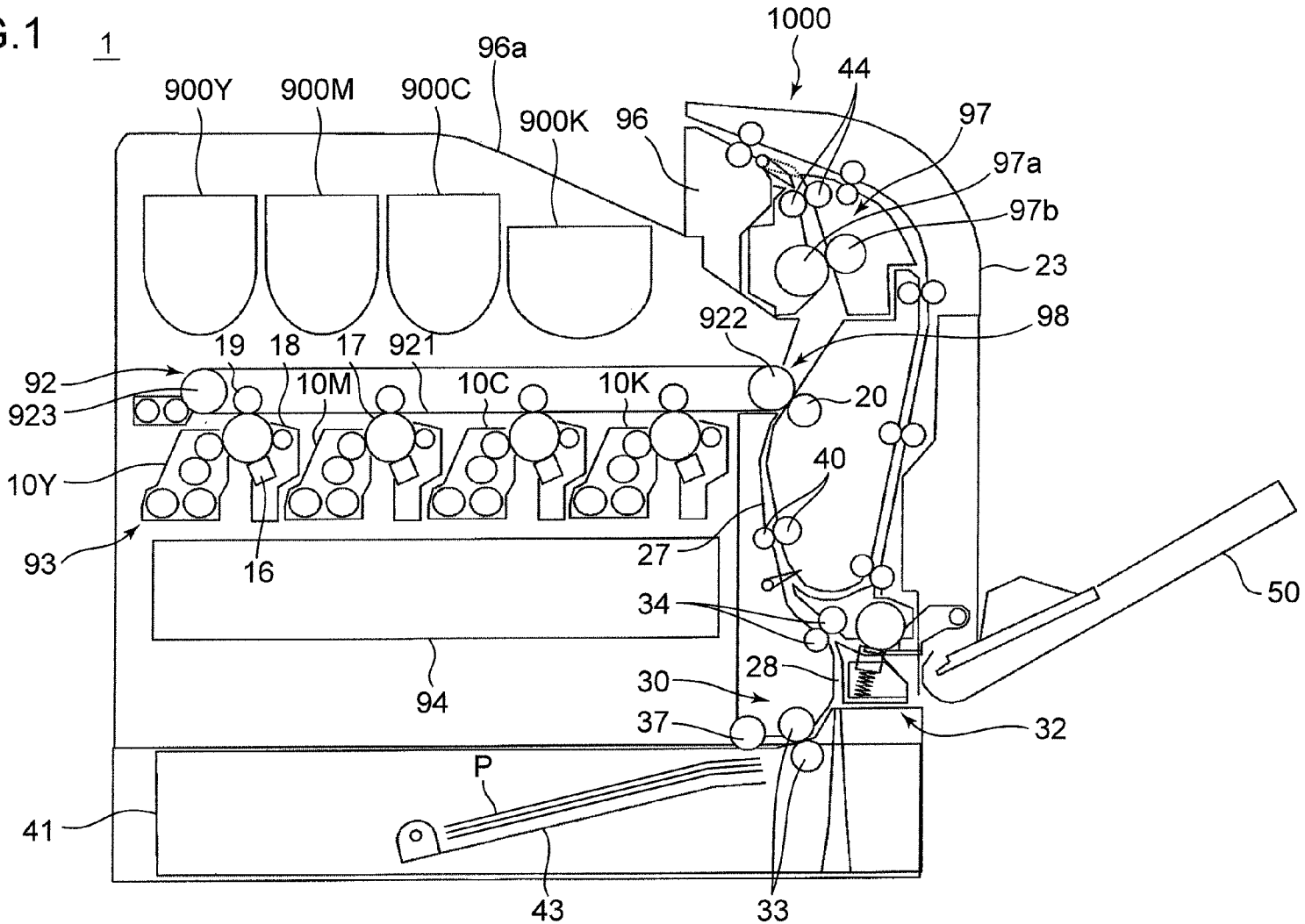
FIG. 1 is a front cross-sectional view showing a schematic structure of an image forming apparatus according to one embodiment of the present invention.

FIG. 1 is a cross-sectional view showing the internal structure of the image forming apparatus according to the present embodiment. In the present embodiment, a multicolor printer 1 is exemplarily shown as one example of the image forming apparatus. The multicolor printer 1 includes an apparatus body 1000 that is connected to a personal computer (not shown) or the like directly or via a LAN.

As shown in FIG. 1, the apparatus body 1000 includes an intermediate transfer unit 92, an image forming unit 93, an exposure unit 94, a fixing unit 97, and a paper ejection unit 96. The apparatus body 1000 further includes a front cover 23. To the front face of the front cover 23, a manual feed tray 50 for the user to manually feed papers is attached in a manner it can be pulled out frontward.

The image forming unit 93 includes a yellow toner use container 900Y that stores yellow toner, a magenta toner use container 900M that stores magenta toner, a cyan toner use container 900C that stores cyan toner, a black toner use container 900K that stores black toner, a yellow toner use development device 10Y that receives the yellow toner from the yellow toner use container 900Y, a magenta toner use development device 10M that receives the magenta toner from the magenta toner use container 900M, a cyan toner use development device 10C that receives the cyan toner from the cyan toner use container 900C, a black toner use development device 10K that receives the black toner from the black toner use container 900K, and four photoconductor drums 17 that each receive the toner from corresponding one of the development devices 10Y, 10M, 10C, and 10K to form a toner image. As the photoconductor drums 17, the photoconductor drums using an amorphous silicon (a-Si) based material can be employed.

Around each photoconductor drum 17, a charger 16, corresponding one of the development devices 10Y, 10M, 10C, and 10K, a transfer roller 19, and a cleaner 18 are arranged. The charger 16 uniformly charges the circumferential surface of the photoconductor drum 17. The transfer roller 19 is disposed so as to oppose to the corresponding photoconductor drum 17 having an intermediate transfer belt 921, of which description will follow, interposed therebetween, so as to form a nip portion between itself and the photoconductor drum 17. The cleaner 18 cleans the circumferential surface of the photoconductor drum 17.

Below the image forming unit 93, an exposure unit 94 is disposed. The exposure unit 94 has a light source and various optical system elements such as a polygon mirror, a reflective mirror, and a deflecting mirror. The exposure unit 94 irradiates the circumferential surface of the photoconductor drums 17 with light based on an image data.

The intermediate transfer unit 92 includes an intermediate transfer belt 921, a drive roller 922 and an idle roller 923. The intermediate transfer belt 921 is tensely arranged between the drive roller 922 and the idle roller 923 as being brought into contact with the circumferential surface of the photoconductor drum 17, and is circulated in a prescribed direction. While the intermediate transfer belt 921 is circulated, it undergoes a primary transfer of a toner image being overlaid by each photoconductor drum 17 at the nip portion.

The primary transfer of the toner image is carried out as follows. First, the charger 16 charges the circumferential surface of the corresponding photoconductor drum 17, and thereafter, the exposure unit 94 exposes the circumferential surface based on image data, to thereby form a latent image on the circumferential surface. Next, the development devices 10Y, 10M, 10C, and 10K each develop the latent image, to thereby form a toner image on the circumferential surface of the corresponding photoconductor drum 17. Then, at the nip portion, the toner image undergoes the primary transfer from the circumferential surface of the photoconductor drum 17 on the intermediate transfer belt 921 as being overlaid. Thus, a multicolor toner image is formed on the intermediate transfer belt 921. The cleaner 18 cleans the circumferential surface of the photoconductor drum 17 after the primary transfer of the toner image is finished.

At a position opposing to the drive roller 922, a secondary transfer roller 20 is disposed as being brought into contact with the drive roller 922. The nip portion between the secondary transfer roller 20 and the drive roller 922 functions as a secondary transfer portion 98. The multicolor toner image on the intermediate transfer belt 921 undergoes a secondary transfer at the secondary transfer portion 98 on a paper P conveyed from a paper cassette (paper storage portion) 41, of which description will be given later. The paper P having undergone the secondary transfer is conveyed to the fixing unit 97.

The fixing unit 97 is configured to perform a fixing process to the toner image on the paper P. The fixing unit 97 includes a fixing roller 97*a* having installed therein a heat source, and a pressure roller 97*b* that is disposed so as to oppose to the fixing roller 97*a* as being brought into contact with the fixing roller 97*a*, to thereby form a fixing nip portion between itself and the fixing roller 97*a*. The paper P having finished with the fixing process is conveyed toward an ejector unit 96 formed at the top portion of the apparatus body 1000 by an ejector roller pair 44 disposed downstream from the fixing roller 97*a* and the pressure roller 97*b* in the fixing unit 97. The ejector unit 96 ejects the paper P conveyed from the fixing unit 97 on a copy receiving tray 96*a* formed on the top surface of the apparatus body 1000.

The paper P that undergoes the secondary transfer at the secondary transfer portion 98 is conveyed to a secondary transfer portion 98 by a paper feed apparatus 30. In the following, a detailed description will be given of the paper feed apparatus 30.

The paper feed apparatus 30 is disposed below the exposure unit 94, and it includes a paper cassette 41 that stores the paper P, and a paper convey path 27 that extends from the paper cassette to the fixing unit 97, so as to convey the paper P from the paper cassette 41 to the secondary transfer portion 98. The paper cassette 41 has a paper placing face 43 on which a stack of papers is placed.

The paper feed apparatus 30 further includes a group of rollers disposed on the paper convey path 27. The group of rollers is constituted by a pick-up roller 37, a first convey roller pair 33, a second convey roller pair 34, and a paper stop roller pair 40, disposed in order from upstream to downstream in a paper convey direction in which the paper P is conveyed from the paper cassette 41 to the secondary transfer portion 98.

The pick-up roller 37 is disposed above the paper placing face 43. The pick-up roller 37 picks up the paper P one by one from the stack of papers placed on the paper placing face 43, and conveys the paper P to the first convey roller pair 33. The first convey roller pair 33 conveys the paper P conveyed from the pick-up roller 37 toward the second convey roller pair 34 positioned further downstream therefrom. The paper convey path 27 has a curved convey portion 28 that is curved between the first convey roller pair 33 and the second convey roller pair 34. The curved convey portion 28 is curved while extending upward from the first convey roller pair 33 toward the second convey roller pair 34. When the paper P is conveyed from the first convey roller pair 33 to the second convey roller pair 34, it is curved along the curved shape of the curved convey portion 28.

The second convey roller pair 34 conveys the paper P conveyed from the first convey roller pair 33 toward the paper stop roller pair 40 positioned further downstream therefrom. The paper stop roller pair 40 conveys the paper P at an appropriate timing toward the secondary transfer portion 98, and also corrects the skew feed of the paper P.

The second convey roller pair 34 not only conveys the paper P from the paper cassette 41 toward the paper stop roller pair 40, but also conveys the paper, which has been placed on the manual feed tray 50 and conveyed by a manual paper feed apparatus 32, toward the paper stop roller pair 40.

The structure of the multicolor printer 1 (image forming apparatus) according to the present embodiment is characterized in that the information of the development device attached and removed is received and stored on the apparatus body side, and in that the apparatus body is capable of recognizing whether or not the development device is attached at the correct position, and whether or not the attached development device is a new development device. In the following, a description will be given of this structure with reference to FIGS. 2 to 5.

Figure 2:
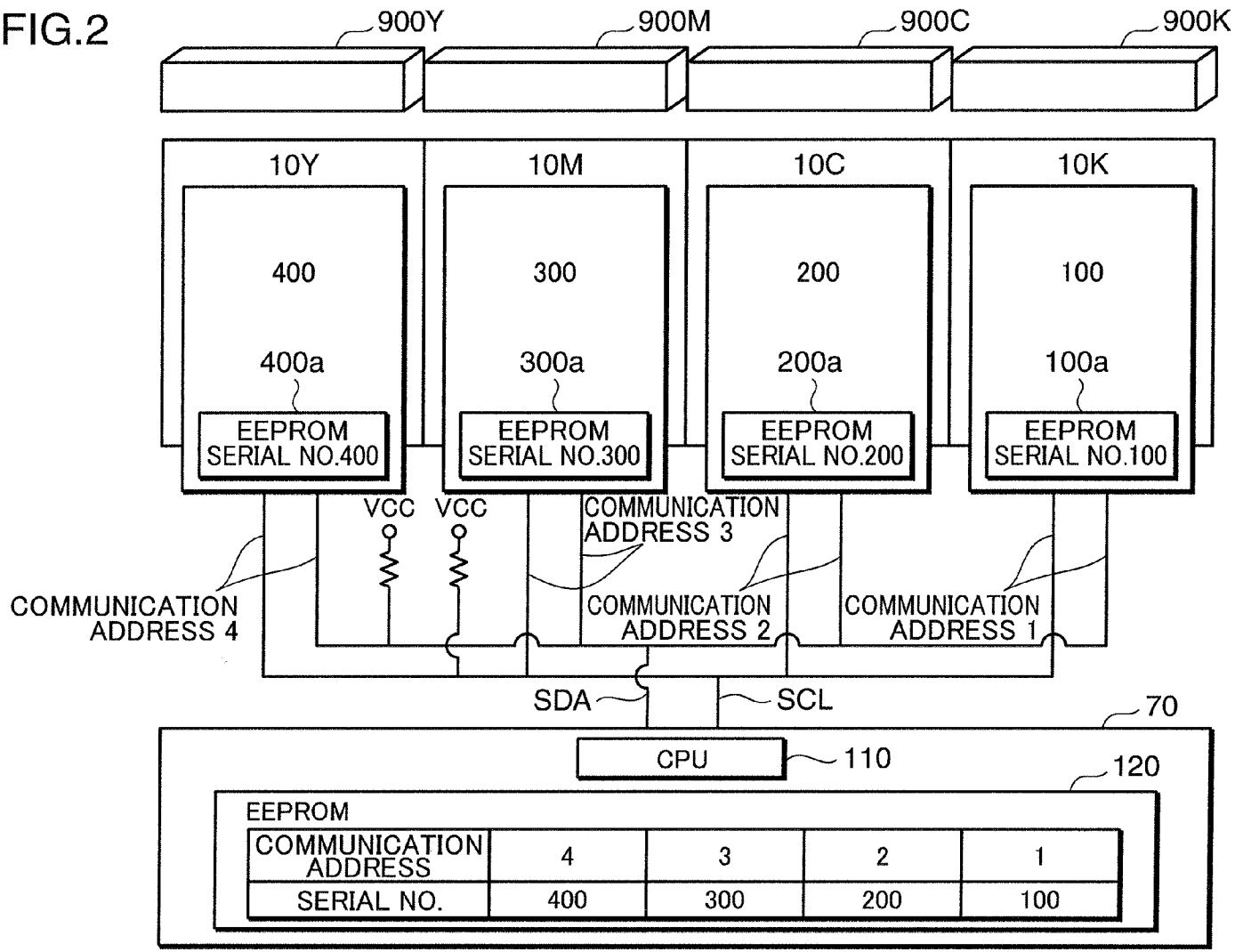
FIG. 2 is an explanatory diagram showing the connection relationship between development devices and a controller on an apparatus body side according to one embodiment of the present invention.
Figure 3:
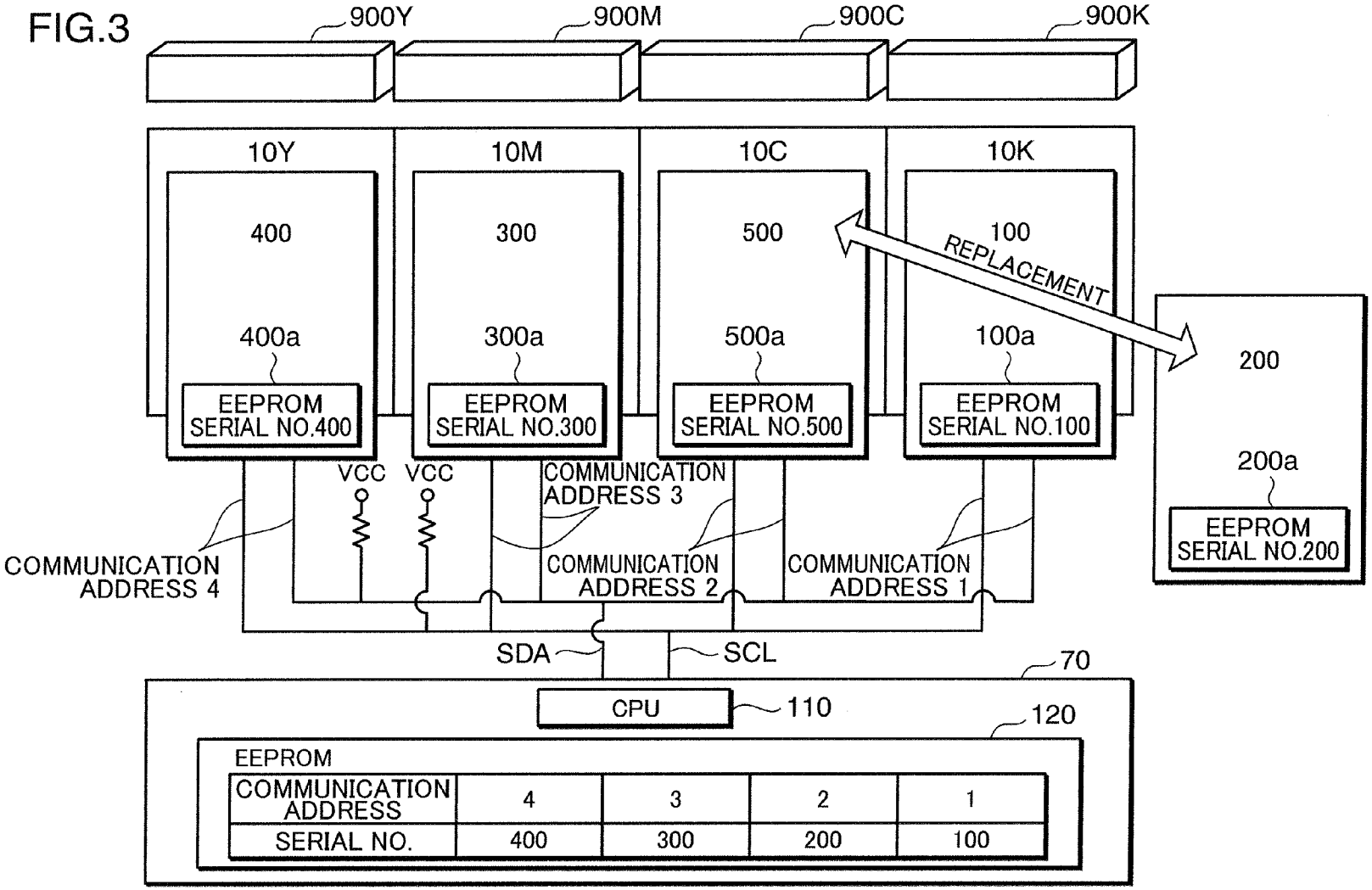
FIG. 3 is an explanatory diagram showing a case where, in the structure shown in FIG. 2, a development device having been in use is replaced by another development device.
Figure 4:
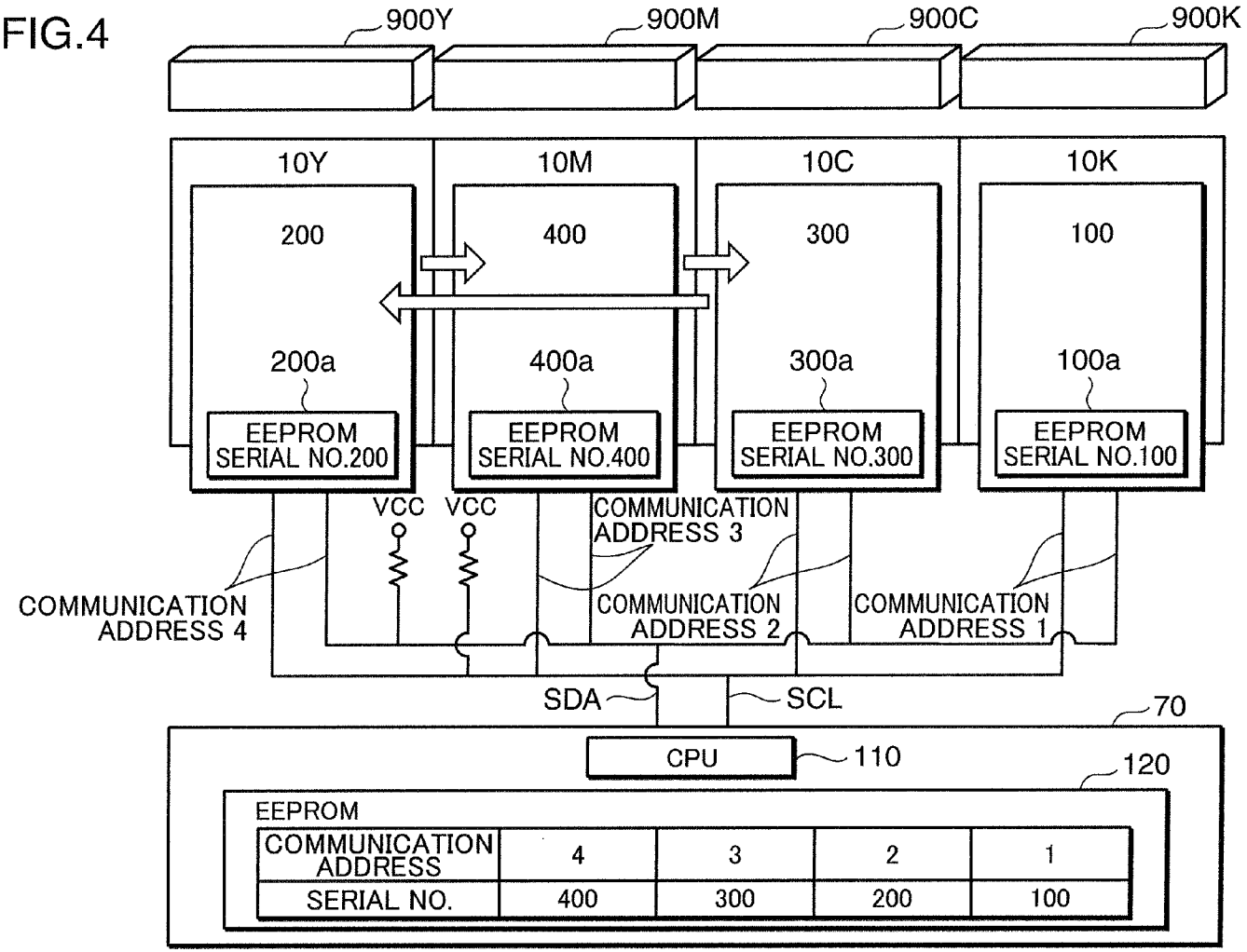
FIG. 4 is an explanatory diagram showing a case where, in the structure shown in FIG. 2, the development device having been in use is removed from the apparatus body, and thereafter reattached to the apparatus body.
Figure 5:
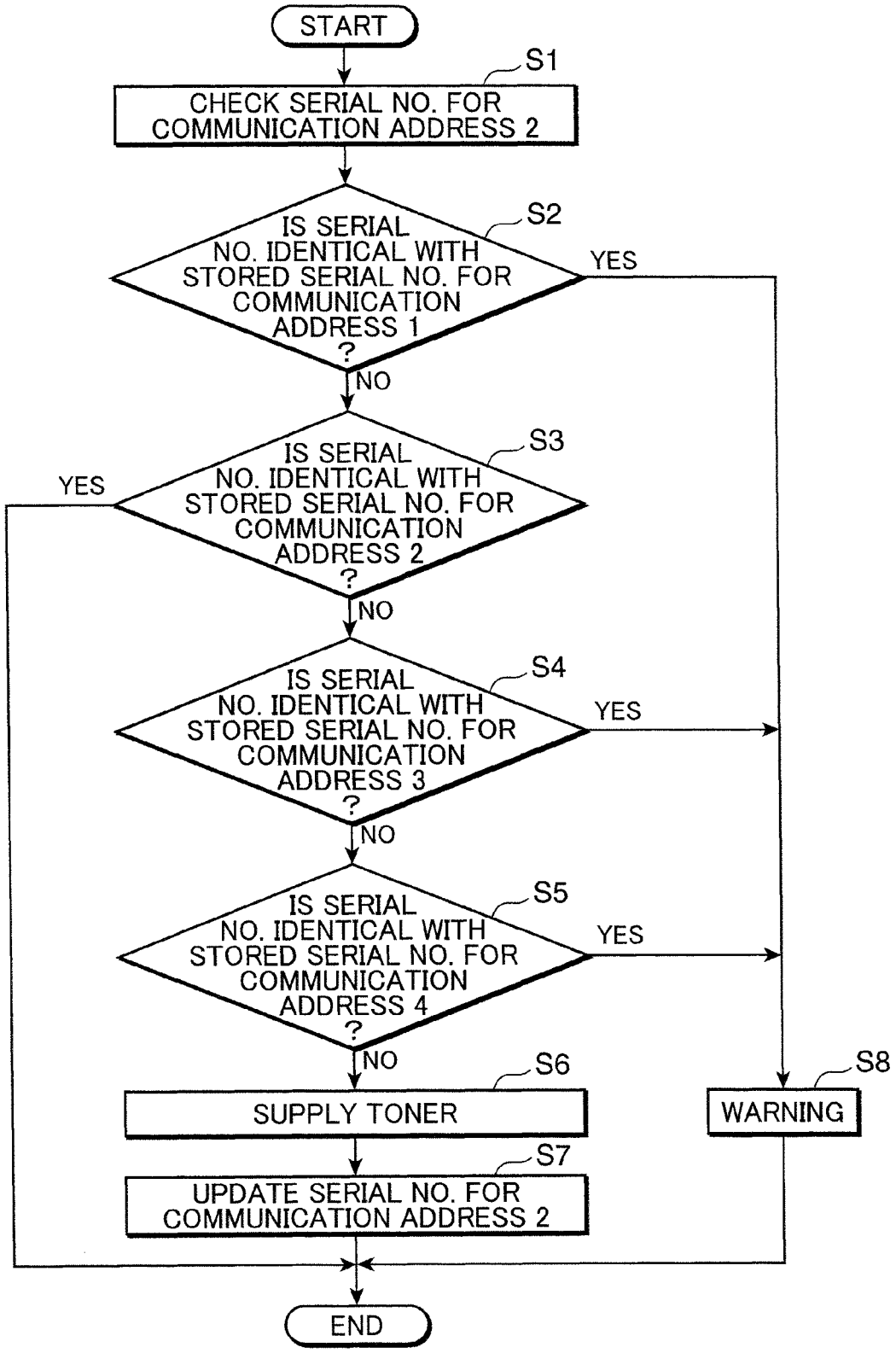
FIG. 5 is a flowchart showing control steps executed by the controller according to the present embodiment.
Figure 6:
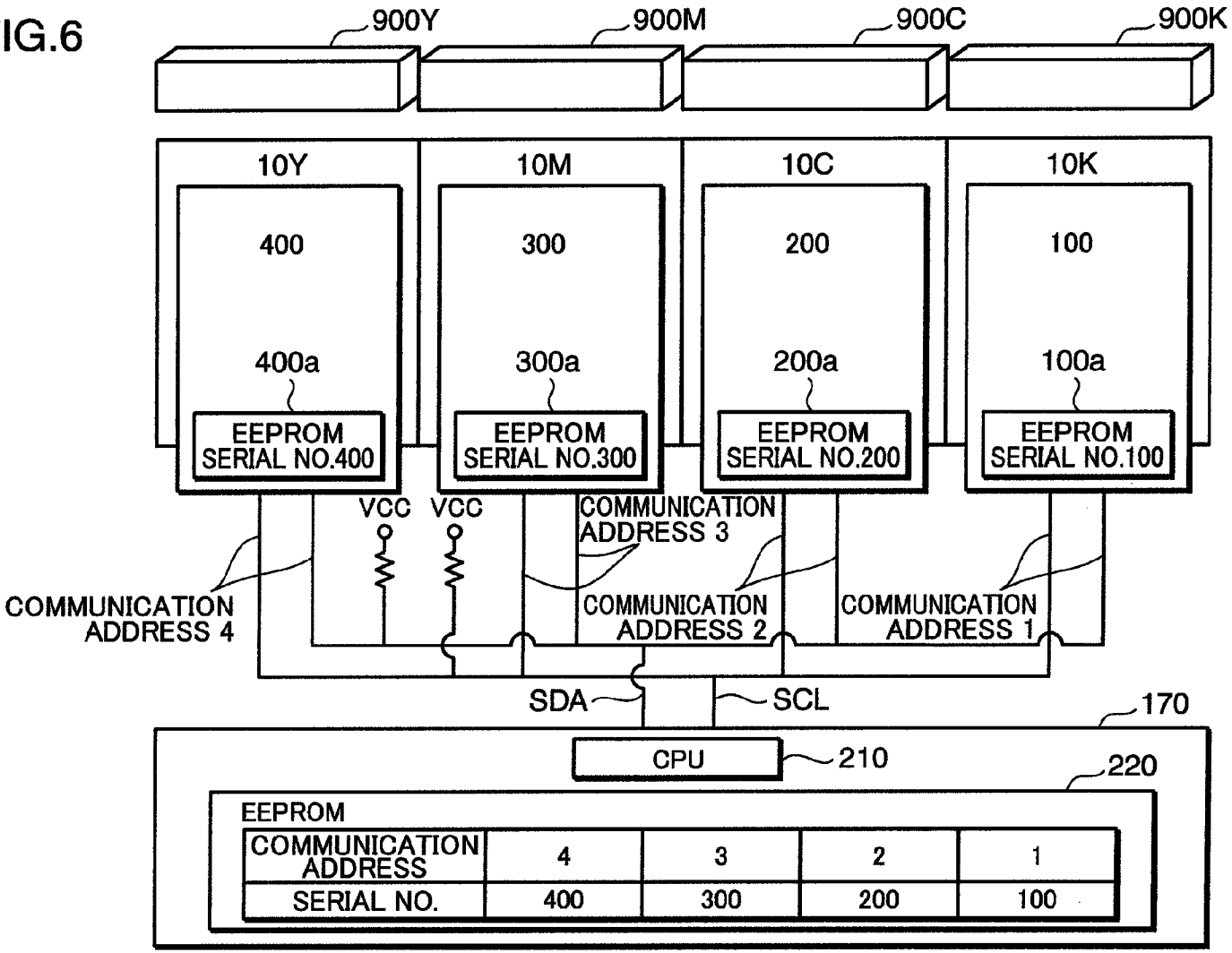
FIG. 6 is an explanatory diagram showing a connection relationship between development devices and a controller on the apparatus body side in a conventional structure.
Figure 7:
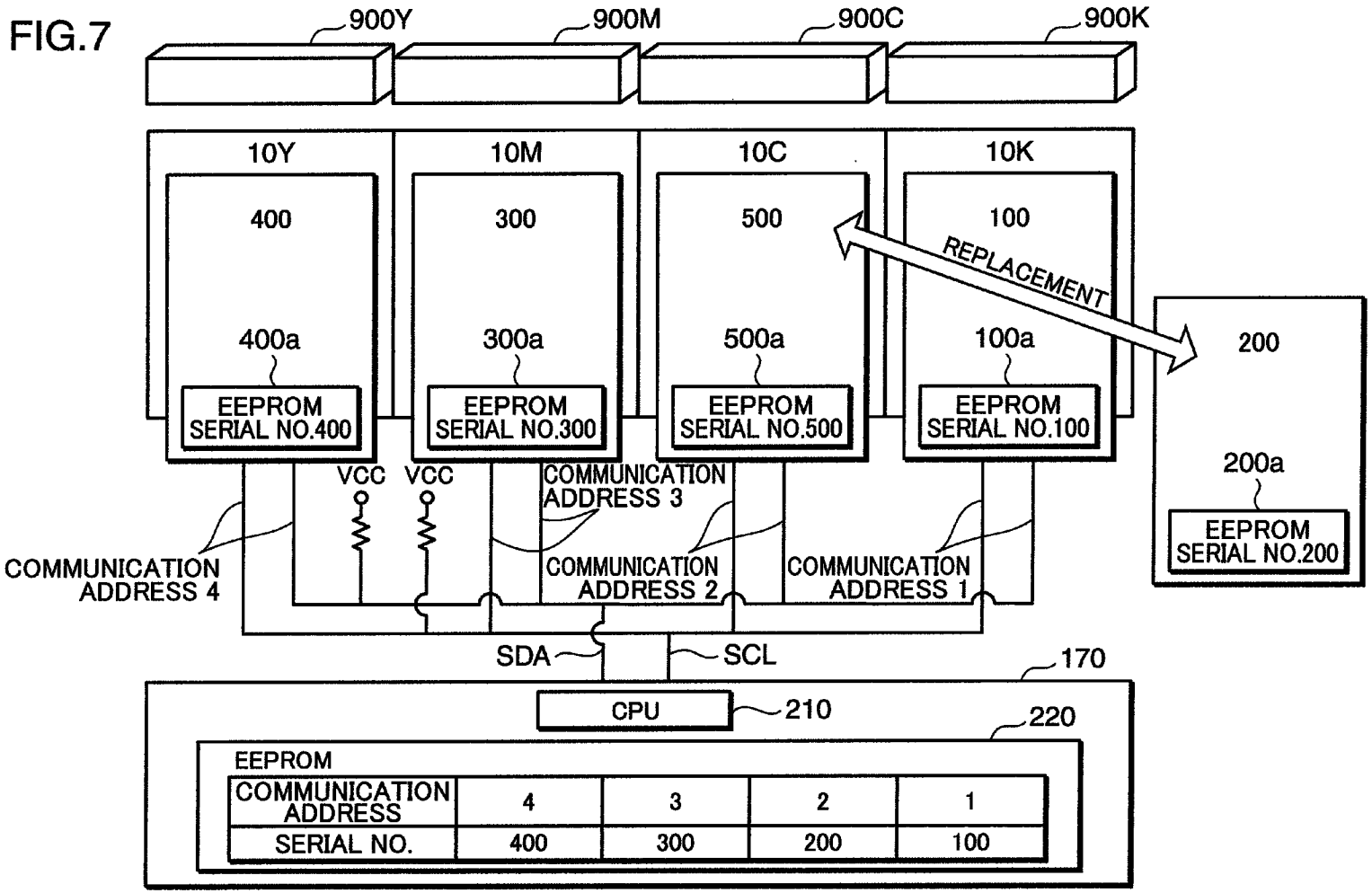
FIG. 7 is an explanatory diagram showing a case where, in the structure shown in FIG. 6, a development device having been in use is replaced by another development device.
Figure 8:
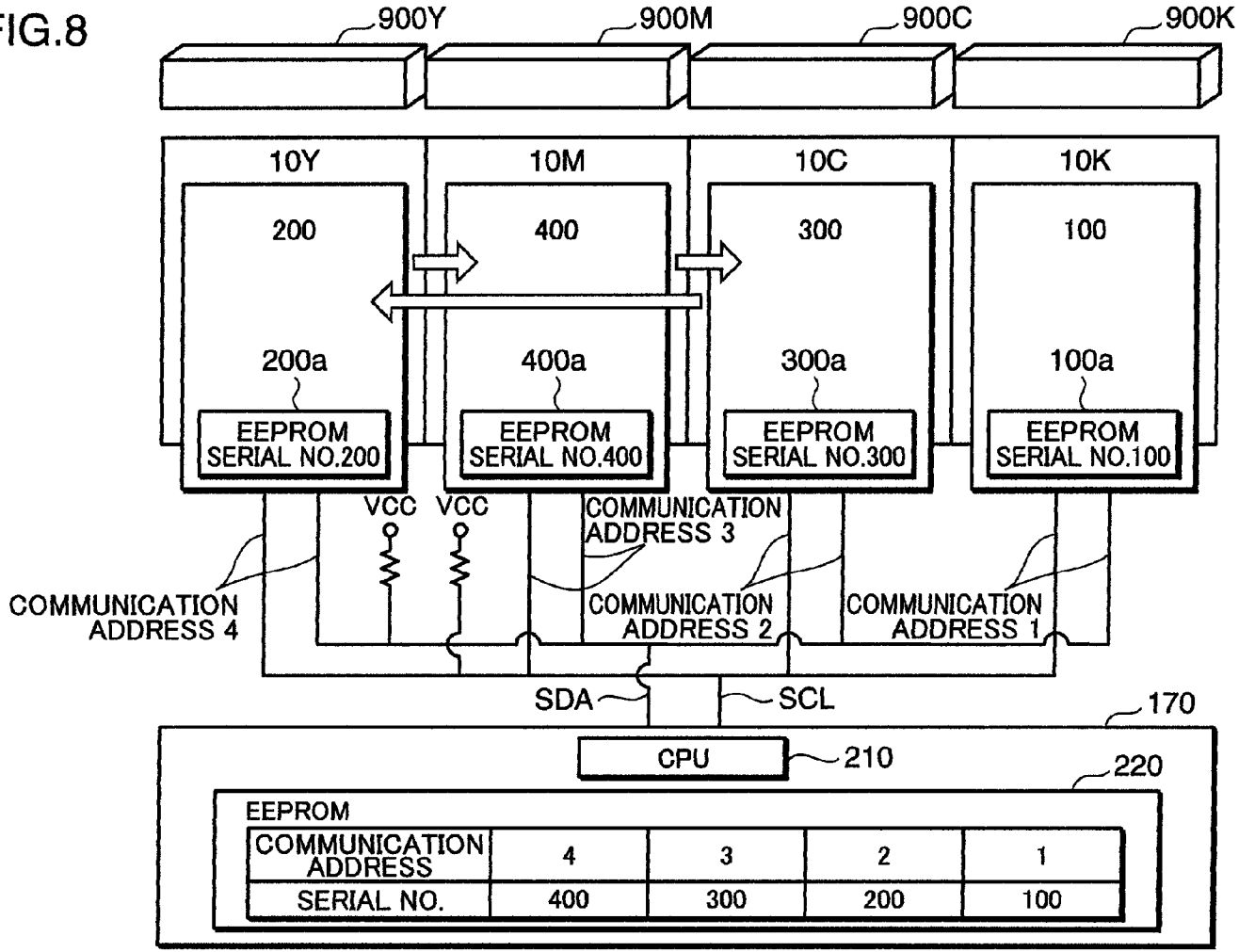
FIG. 8 is an explanatory diagram showing a case where, in the structure shown in FIG. 6, the development device having been in use is removed from the apparatus body, and thereafter reattached to the apparatus body.
Figure 9:
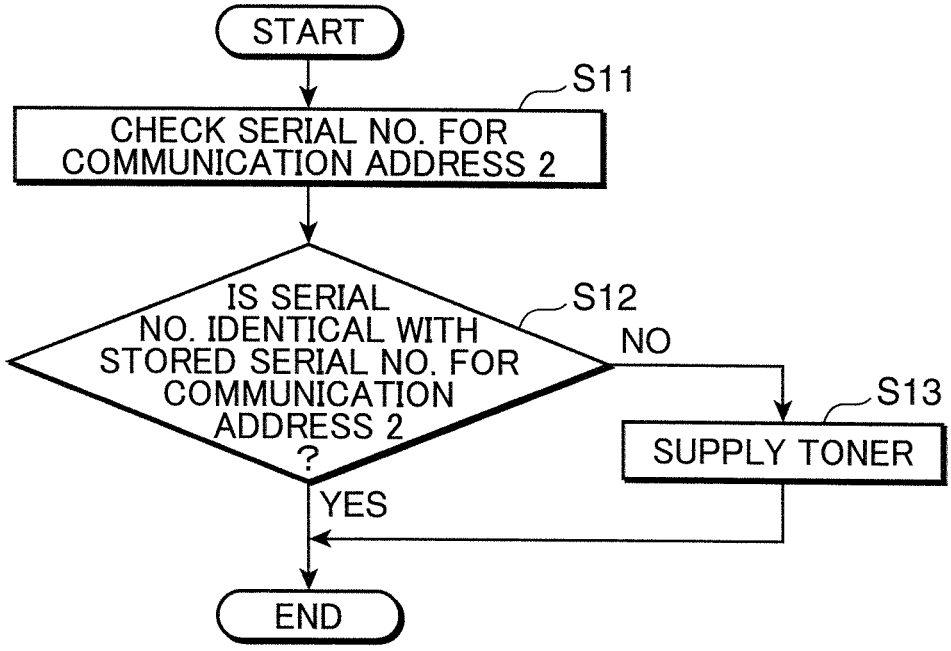
FIG. 9 is a flowchart showing control steps executed by the controller of the conventional structure.

FIG. 2 is an explanatory diagram showing the connection relationship between a plurality of development devices and a controller on the apparatus body side according to the present embodiment. FIG. 3 is an explanatory diagram showing a case where, in the present image forming apparatus, a development device having been in use is replaced by another development device. FIG. 4 is an explanatory diagram showing a case where, in the present image forming apparatus, a development device having been in use is removed from the apparatus body, and thereafter attached to the apparatus body again. FIG. 5 is a flowchart showing control steps executed by the controller according to the present embodiment.

As shown in FIG. 2, attached to the apparatus body 1000 are a development device 400 as the yellow toner use development device 10Y, a development device 300 as the magenta toner use development device 10M, a development device 200 as the cyan toner use development device 10C, and a development device 100 as the black toner use development device 10K. The yellow toner use container 900Y supplies toner of its color to the development device 400; the magenta toner use container 900M supplies toner of its color to the development device 300; the cyan toner use container 900C supplies toner of its color to the development device 200; and the black toner use container 900K supplies toner of its color to the development device 100.

These development devices 100, 200, 300, and 400 are provided with EEPROMs 100*a*, 200*a*, 300*a*, and 400*a* as slave devices. The EEPROMs 100*a*, 200*a*, 300*a*, and 400*a* have stored therein identification information of the development devices 100, 200, 300, and 400. The identification information refers to information that can uniquely specify each of the development devices, such as serial numbers, manufacturer's serial numbers and the like. Such identification information is not limited to numbers, and it may be symbols. In the present embodiment, the identification information pieces for the development devices 100, 200, 300, and 400 are designated as "serial No. 100", "serial No. 200", "serial No. 300", and "serial No. 400", respectively.

On the other hand, a controller 70 on the apparatus body side is provided with a CPU 110 as a master device. To the CPU 110, an EEPROM 120 is connected. As the EEPROM of the present embodiment, for example, the one having built therein a serial interface circuit such as an $I^2C$ bus can be employed.

As shown in FIGS. 2 to 4, the EEPROMs 100*a*, 200*a*, 300*a*, and 400*a* and the CPU 110 are connected to each other via a serial bus. In the present embodiment, the description will proceed taking up an exemplary case where an $I^2C$ bus is used as the serial bus. The $I^2C$ bus is a two-line serial bus, in which the master device and the slave devices are connected to each other via an SCL and an SDA. The SCL is a clock line that transmits the clock signal, and the SDA is a data line that transmits data, addresses and the like.

In the present embodiment, in the $I^2C$ bus, the EEPROM 100*a* of the development device 100 used as the black toner use development device 10K is connected to the port with a communication address 1; the EEPROM 200*a* of the development device 200 used as the cyan toner use development device 10C is connected to the port with a communication address 2; the EEPROM 300*a* of the development device 300 used as the magenta toner use development device 10M is connected to the port with a communication address 3; and the EEPROM 400*a* of the development device 400 used as the yellow toner use development device 10Y is connected to the port with a communication address 4.

The CPU 110 on the apparatus body side reads via the $I^2C$ bus the serial numbers that uniquely specify the development devices 100, 200, 300, and 400, and stores them in the storage areas in the EEPROM 120 respectively corresponding to the communication addresses 1 to 4. That is, in the storage area in the EEPROM 120 corresponding to the communication address 1, the "serial No. 100" of the development device 100 attached to the port with the communication address 1 is stored. Similarly, in the storage area corresponding to the communication address 2, the "serial No. 200" of the development device 200 attached to the port with the communication address 2 is stored. In the storage area corresponding to the communication address 3, the "serial No. 300" of the development device 300 attached to the port with the communication address 3 is stored. In the storage area corresponding to the communication address 4, the "serial No. 400" of the development device 400 attached to the port with the communication address 4 is stored.

Next, the following discusses a case based on an assumption that the development device 200 currently in use as the cyan toner use development device 10C is removed from the apparatus body, and thereafter, a new development device or a development device having been in use for the purpose other than the cyan toner use development device 10C is attached at the position of the cyan toner use development device 10C. Now, a description will be given of the steps of determination made by the controller 70 according to the present embodiment as to whether or not the development device is attached at the correct position, and as to whether or not the attached development device is a new development device, with reference to FIGS. 3 and 5.

First, a description will be given of a case where, as shown in FIG. 3, the development device 200 with the "serial No. 200" having been in use as the cyan toner use development device 10C is replaced by a new development device 500 with the "serial No. 500".

As shown in FIG. 5, when the development device 500 of with the "serial No. 500" is attached to the port with the communication address 2, the CPU 110 checks the "serial No. 500" of the attached development device 500 via the $I^2C$ bus (S1). Then, it determines whether or not the "serial No. 500" at the communication address 2 agrees with any of the serial numbers corresponding to the communication addresses 1 to 4 stored in the EEPROM 120.

Specifically, in S2, whether or not the "serial No. 500" agrees with the serial number stored in the storage area in the EEPROM 120 corresponding to the communication address 1 is determined. In this case, the serial number stored in the storage area corresponding to the communication address 1 is "100" and, therefore, the serial numbers disagree with each other (NO in S2). Next, in S3, whether or not the "serial No. 500" agrees with the serial number stored in the storage area in the EEPROM 120 corresponding to the communication address 2 is determined. In this case, the serial number stored in the storage area corresponding to the communication address 2 is "200" and, therefore, the serial numbers disagree with each other (NO in S3). Next, in S4, whether or not the "serial No. 500" agrees with the serial number stored in the storage area in the EEPROM 120 corresponding to the communication address 3 is determined. In this case, the serial number stored in the storage area corresponding to the communication address 3 is "300" and, therefore, the serial numbers disagree with each other (NO in S4). Next, in S5, whether or not the "serial No. 500" agrees with the serial number stored in the storage area in the EEPROM 120 corresponding to the communication address 4 is determined. In this case, the serial number stored in the storage area corresponding to the communication address 4 is "400" and, therefore, the serial numbers disagree with each other (NO in S5). Consequently, it is found that the "serial No. 500" of the development device 500 attached to the port with the communication address 2 agrees with none of the serial numbers corresponding to the communication addresses stored in the EEPROM 120. Thus, the CPU 110 recognizes that a new development device is attached to the port with the communication address 2, and the new development device 500 attached as the cyan toner use development device 10C is supplied with toner from the cyan toner use container 900C (S6).

Thereafter, the CPU 110 updates the serial number stored in the storage area corresponding to the communication address 2 in the EEPROM 120 from "200" to "500" (S7).

Next, the following discusses a case where the development device 200 with the "serial No. 200" having been in use as the cyan toner use development device 10C, the development device 300 with the "serial No. 300" having been in use as the magenta toner use development device 10M, and the development device 400 with the "serial No. 400" having been in use as the yellow toner use development device 10Y, are once removed from the apparatus body for the purpose of maintenance or the like, and thereafter attached to the apparatus body again. Here, as shown in FIG. 4, it is assumed that the development devices 200, 300, and 400 are mistakenly attached at the positions which are not the intended positions. In the following, a description will be given of a control routine executed by the CPU 110 focusing on the port with the communication address 2, with reference to FIG. 5.

When the development device 300 with the "serial No. 300" is attached to the port with the communication address 2, the CPU 110 checks the "serial No. 300" of the attached development device via the $I^2C$ bus (S1). Then, the CPU 110 determines whether or not the "serial No. 300" of the development device 300 attached to the port with the communication address 2 agrees with any of the serial numbers corresponding to the communication addresses 1 to 4 stored in the EEPROM 120.

Specifically, in S2, whether or not the "serial No. 300" agrees with the serial number stored in the storage area in the EEPROM 120 corresponding to the communication address 1 is determined. In this case, the serial number stored in the storage area corresponding to the communication address 1 is "100" and, therefore, the serial numbers disagree with each other (NO in S2). Next, in S3, whether or not the "serial No. 300" agrees with the serial number stored in the storage area in the EEPROM 120 corresponding to the communication address 2 is determined. In this case, the serial number stored in the storage area corresponding to the communication address 2 is "200" and, therefore, the serial numbers disagree with each other (NO in S3). Next, in S4, whether or not the "serial No. 300" agrees with the serial number stored in the storage area in the EEPROM 120 corresponding to the communication address 3 is determined. In this case, the serial number stored in the storage area corresponding to the communication address 3 is "300" and, therefore, the serial numbers agree with each other (YES in S4). Thus, the CPU 110 recognizes that the development device 300 attached to the port with the communication address 2 is not a new development device. The CPU 110 further recognizes that the development device 300 attached to the port with the communication address 2 is mistakenly attached to the port with the communication address 2, though it should have been attached to the port with the communication address 3.

In this case, the CPU 110 does not allow the toner to be supplied to the development device 300 mistakenly attached to the port with the communication address 2, and causes a warning message to appear on a display panel (not shown) of the input operational portion, informing the user that the development device is attached to the wrong place (S8). In this case, a warning sound may be emitted.

As described in the foregoing, with the structure of the present embodiment, when any one of the development devices is removed from the apparatus body 1000, and thereafter, a development device is attached at the position where the removal took place, the controller 70 reads the serial number as the identification information of the development device attached to that position. When the read serial number disagrees with the serial number of the position stored in the EEPROM 120, and agrees with the serial number of other position, the controller 70 is configured to determine that the development device is mistakenly attached, and prohibit the supply of the toner to the attached development device from the toner container corresponding to the attached position. Consequently, when the development device once removed from the apparatus body is reattached to the apparatus body 1000, even if the development device is mistakenly attached to any position other than the position it should have been attached, by executing the simple step of comparing the serial number that can uniquely specify the development device and that is stored in the EEPROM of each development device against the serial number stored in the EEPROM 120 of the controller 70 on the apparatus body side, the controller 70 can recognize the occurrence of mistaken attachment. Thus, with a simple structure, it becomes possible to prevent the toner of wrong color from being supplied from the toner container to the mistakenly attached development device.

Further, when at least one development device is removed from the apparatus body 1000, and thereafter the development device is attached to the apparatus body 1000, the controller 70 compares all of the serial numbers stored in the EEPROM 120 against the serial number of the attached development device. When the serial number of the attached development device agrees with none of the serial numbers stored in the EEPROM 120, the controller 70 determines that a new development device is attached. This makes it possible to surely determine that a new development device is attached, and the toner is allowed to be supplied to the new development device. Consequently, when the development device having been temporarily removed outside the apparatus for the purpose of maintenance or the like is mistakenly attached to any position other than the position it should have been attached, it becomes possible to prevent the mistaken determination that a new development device is attached, which may otherwise cause the toner to be supplied from the toner container to the development device which should have not been supplied with. Thus, it becomes possible to prevent the toner of the attached development device from being blended with the toner of other color.

Further, when it is determined that the development device is mistakenly attached, by giving a warning, for example, by causing a warning message to appear on the display panel (not shown) of the input operational portion so as to inform the user that the development device is attached to the wrong place or by emitting a warning sound, it becomes possible to let the user to recognize the occurrence of the mistaken attachment, and to prompt the user to reattach the development device at the correct position.

In the foregoing, the description has been given focusing on the development device attached to the port with the communication address 2. However, it goes without saying that, as to the development devices respectively attached to the ports with the communication addresses 1, 3 and 4 also, the controller 70 determines as to whether or not each of the development devices is attached at its correct position, and as to whether or not the attached development device is a new development device, based on the similar steps.

In the present embodiment, the description has been given of the structure in which each development device includes an EEPROM as a storage portion for storing therein its own serial number (identification information), the present invention is not limited thereto. Other non-volatile memory, such as a mask ROM, a PROM, an EPROM, an FeRAM, a flash memory or the like can be employed, so long as it functions as the storage portion that is capable of storing information allowing the CPU on the apparatus body side to perform a reading operation therefrom, in a state where each development device is attached to the apparatus body.

In the present embodiment, while the description has been given of the structure in which the development devices and the CPU 110 on the apparatus body side are connected to each other via the two-line serial bus, the present invention is not limited thereto. The only requirement for the connection structure is that, in a state where the development devices are connected to the apparatus body, the CPU 110 on the apparatus body side is capable of reading the serial numbers from the EEPROMs of the development devices.

With the structure described in the foregoing, the development devices provided attachably and removably to the apparatus body, so as to respectively supply the apparatus body with the developers of the plurality of colors respectively supplied from the plurality of developer containers respectively include first storage portions that are communicably connected to a controller provided on the apparatus body side and that have stored therein identification information pieces each uniquely identifying corresponding one of the development devices. On the other hand, the controller includes a second storage portion that reads and stores the identification information pieces of all the development devices attached to the apparatus body. When any of the development devices is removed from the apparatus body, and thereafter any of the development devices is attached at a position where the removal took place, the controller reads an identification information piece of the development device attached at the position, and when the read identification information piece disagrees with an identification information piece of the development device at the position stored in the second storage portion and agrees with an identification information piece of another one of the development devices at another position, the controller determines that the development device is mistakenly attached and prohibits the supply of corresponding one of the developers. Consequently, when the development device once removed from the apparatus body is reattached to the apparatus body, even if the development device is mistakenly attached to any position other than the position it should have been attached, by executing the simple step of comparing the identification information pieces (for example, serial numbers, manufacturer's serial numbers and the like) that each can uniquely specify the development device and stored in the first storage portion of each development device against the identification information pieces stored in the second storage portion of the controller on the apparatus body side, it becomes possible to recognize the occurrence of mistaken attachment. Thus, with a simple structure, it becomes possible to prevent the developer of wrong color from being supplied from the developer container to the mistakenly attached development device.

Preferably, when at least one of the development devices is removed from the apparatus body, and thereafter a development device is attached to the apparatus body, the controller reads an identification information piece of the attached development device, checks whether or not the read identification information piece agrees with any one of the identification information pieces of all the development devices stored in the second storage portion. When the read identification information piece disagrees with the identification information pieces of all the development devices, the controller determines that a new development device is attached, and permits the supply of corresponding one of the developers.

With the structure described in the foregoing, when at least one development device is removed from the apparatus body, and thereafter the development device is attached to the apparatus body, the controller compares all of the identification information pieces stored in the second storage portion against the identification information piece of the attached development device. When the identification information piece of the attached development device agrees with none of the identification information pieces stored in the second storage portion, the controller determines that a new development device is attached. This makes it possible to surely determine that a new development device is attached, and the developer is allowed to be supplied to the new development device. Consequently, when the development device having been temporarily removed outside the apparatus for the purpose of maintenance or the like is mistakenly attached to any position other than the position it should have been attached, it becomes possible to prevent the mistaken determination that a new development device is attached, which may otherwise cause the developer to be supplied from the developer container to the development device which should have not been supplied with. Thus, it becomes possible to prevent the developer of the attached development device from being blended with the developer of other color.

Further, preferably, when the controller determines that the development device is mistakenly attached, the controller gives a warning.

With the structure described in the foregoing, when the controller determines that the development device is mistakenly attached, by giving a warning, for example, by causing a warning message to appear on the display panel (not shown) of the input operational portion so as to inform the user that the development device is attached to the wrong place or by emitting a warning sound, it becomes possible to let the user to recognize the occurrence of the mistaken attachment, and to prompt the user to reattach the development device at the correct position.

This application is based on Japanese Patent application serial No. 2009-237579 filed in Japan Patent Office on Oct. 14, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus capable of forming a multicolor image using developers of a plurality of colors, comprising:

a plurality of developer containers respectively storing the developers of the plurality of colors;

a plurality of development devices provided attachably and removably to an apparatus body, so as to respectively supply the apparatus body with the developers of the plurality of colors respectively supplied from the plurality of developer containers; and a controller provided on a side of the apparatus body, so as to control supply of the developers from the developer containers to the development devices, wherein the development devices respectively include first storage portions that are communicably connected to the controller and that have respectively stored therein identification information pieces each uniquely identifying a corresponding one of the development devices, the controller includes a second storage portion that reads and stores the identification information pieces of all the development devices attached to the apparatus body, when any of the development devices is removed from the apparatus body, and thereafter any of the development devices is attached at a position where the removal took place, the controller reads an identification information piece of the development device attached at the position, and when the read identification information piece disagrees with an identification information piece of the development device at the position stored in the second storage portion, and agrees with an identification information piece of another one of the development devices at another position, the controller determines that the development device is mistakenly attached and prohibits the supply of corresponding one of the developers, when at least one of the development devices is removed from the apparatus body, and thereafter a development device is attached to the apparatus body, the controller reads an identification information piece of the attached development device, checks whether or not the read identification information piece agrees with any one of the identification information pieces of all the development devices stored in the second storage portion, and when the read identification information piece disagrees with the identification information pieces of all the development devices, the controller determines that a new development device is attached, and permits the supply of corresponding one of the developers.

2. The image forming apparatus according to claim 1, wherein the development devices and the controller are connected to each other via a two-line serial bus.

3. The image forming apparatus according to claim 1, wherein when the controller determines that the development device is mistakenly attached, the controller gives a warning.

4. The image forming apparatus according to claim 3, wherein the controller gives the warning by causing a warning message to appear on a display panel of an input operational portion, informing a user that the development device is attached to a wrong place.

5. The image forming apparatus according to claim 1, wherein when the controller determines that the development device is mistakenly attached, the controller gives a warning.

6. The image forming apparatus according to claim 5 is, wherein the controller gives the warning by causing a warning message to appear on a display panel of an input operational portion, informing a user that the development device is attached to a wrong place.

7. An image forming apparatus capable of forming a multicolor image using developers of a plurality of colors, comprising:

a plurality of development devices provided attachably and removably to an apparatus body, so as to respectively supply the apparatus body with the developers of the plurality of colors; and a controller provided on a side of the apparatus body, wherein the development devices respectively include first storage portions that are communicably connected to the controller and that respectively have stored therein identification information pieces each uniquely identifying corresponding one of the development devices, the controller includes a second storage portion that reads and stores the identification information pieces of all of the development devices attached to the apparatus body, and when two or more than two of the development devices, including the development device to be attached at a first position are removed from the apparatus body, and thereafter development devices are attached at positions where the removal took place, the controller reads an identification information piece of the development device attached at the first position, and when the read identification information piece disagrees with an identification information piece stored in the second storage portion for the development device to have been attached at the first position, and agrees with an identification information piece stored in the second storage portion for one of the development devices to have been attached at a position different from the first position, the controller determines that at least the development device attached at the first position is attached mistakenly.

8. The image forming apparatus according to claim 7, further comprising a plurality of developer containers respectively storing the developers of the plurality of colors, wherein:

the controller controls supply of the developers from the developer containers to the development devices, the controller prohibits the supply of corresponding one of the developers when determining that the developing device is mistakenly attached.

9. The image forming apparatus according to claim 7, wherein the the development devices and the controller are connected to each other via a two-line serial bus.

10. The image forming apparatus according to claim 7, wherein the two or more than two development devices include three development devices.

* * * * *